US008474743B2

(12) United States Patent
Pabst et al.

(10) Patent No.: US 8,474,743 B2
(45) Date of Patent: Jul. 2, 2013

(54) SKI-LIFT SEAT RETURN DEVICE

(75) Inventors: Otto Pabst, Rio di Pusteria (IT); Christian Bacher, Gossensass (IT)

(73) Assignee: Rolic Invest S.AR.L., Luxembourg (LU)

( * ) Notice: Subject to any disclaimer, the term of this patent is extended or adjusted under 35 U.S.C. 154(b) by 382 days.

(21) Appl. No.: 12/849,440

(22) Filed: Aug. 3, 2010

(65) Prior Publication Data

US 2011/0185937 A1 Aug. 4, 2011

(30) Foreign Application Priority Data

Aug. 4, 2009 (IT) ..... MI2009A1414

(51) Int. Cl.
*B65H 75/30* (2006.01)

(52) U.S. Cl.
USPC ..... 242/381; 242/381.5

(58) Field of Classification Search
USPC ..... 242/381, 381.5, 396
See application file for complete search history.

(56) References Cited

U.S. PATENT DOCUMENTS

| | | | | | |
|---|---|---|---|---|---|
| 472,211 | A | | 4/1892 | Fralinger | |
| 1,944,446 | A | | 1/1934 | McGowen | |
| 2,443,763 | A | * | 6/1948 | Dahlgren et al. | 242/390.2 |
| 2,662,587 | A | | 12/1953 | McIlvaine | |
| 2,710,650 | A | | 6/1955 | Sowder | |
| 2,896,912 | A | * | 7/1959 | Faugier et al. | 242/381.6 |
| 2,985,224 | A | | 5/1961 | Sowder | |
| 3,170,412 | A | | 2/1965 | Sowder | |
| 3,587,474 | A | * | 6/1971 | Fuchs | 104/173.2 |
| 3,934,517 | A | | 1/1976 | Hirsig | |
| 4,009,844 | A | * | 3/1977 | Gomez | 242/381 |
| 4,185,562 | A | | 1/1980 | Hatori et al. | |
| 4,226,187 | A | | 10/1980 | Paulsen et al. | |
| 4,269,123 | A | | 5/1981 | Segafredo | |
| 4,280,411 | A | | 7/1981 | Katayose et al. | |
| 4,462,314 | A | | 7/1984 | Kunczynski | |
| 4,470,355 | A | | 9/1984 | Kunczynski | |
| 4,473,011 | A | | 9/1984 | Wuschek | |
| 4,640,197 | A | | 2/1987 | Brian | |
| 4,641,587 | A | | 2/1987 | Dalliard | |
| 4,671,187 | A | | 6/1987 | Kunczynski | |

(Continued)

FOREIGN PATENT DOCUMENTS

| | | |
|---|---|---|
| AT | 315910 | 6/1974 |
| AT | 342655 | 4/1978 |

(Continued)

OTHER PUBLICATIONS

Italian Search Report for IT MI20091414 dated Jun. 22, 2010.

*Primary Examiner* — Sang Kim
(74) *Attorney, Agent, or Firm* — Neal, Gerber & Eisenberg LLP

(57) ABSTRACT

A ski-lift seat return device having a supporting structure; a reel mounted to rotate about an axis with respect to the supporting structure; a cable wound about the reel; a spring mechanism for opposing unwinding of the cable, and for rewinding the cable unwound off the reel; and a contactless magnetic brake connected to the reel and the supporting structure to adjust the brake torque as a function of the rotation speed of the reel; and wherein the magnetic brake has a first wall integral with and preferably defining part of the supporting structure; and a second wall connected movably to the reel and moved towards the first wall by the rotation speed of the reel; the first and second wall being coupled magnetically to each other.

18 Claims, 3 Drawing Sheets

U.S. PATENT DOCUMENTS

| | | | | |
|---|---|---|---|---|
| 4,833,997 | A | 5/1989 | Cathiard | |
| 4,898,100 | A | 2/1990 | Brochand | |
| 5,107,771 | A | 4/1992 | Kainz | |
| 5,113,768 | A | 5/1992 | Brown | |
| 5,226,368 | A | 7/1993 | Brochand et al. | |
| 5,515,789 | A | 5/1996 | Brochand et al. | |
| 5,562,040 | A | 10/1996 | Egli | |
| 5,582,109 | A | 12/1996 | Levi et al. | |
| 5,595,122 | A | 1/1997 | Levi et al. | |
| 6,036,282 | A | 3/2000 | Clarke et al. | |
| 6,168,107 | B1 * | 1/2001 | Bishop et al. | 242/381 |
| 6,345,578 | B1 | 2/2002 | Pabst | |
| 6,543,366 | B2 | 4/2003 | Pabst et al. | |
| 6,585,232 | B2 | 7/2003 | Rechenmacher | |
| 7,410,068 | B1 | 8/2008 | Andreetto | |
| 7,549,377 | B2 | 6/2009 | Pabst | |
| 2002/0026839 | A1 | 3/2002 | Lehtovaara | |
| 2002/0088368 | A1 | 7/2002 | Pabst et al. | |
| 2006/0249718 | A1 | 11/2006 | Levi | |
| 2007/0169660 | A1 | 7/2007 | Pabst | |
| 2008/0115689 | A1 | 5/2008 | Heil et al. | |
| 2009/0165666 | A1 | 7/2009 | Pabst et al. | |
| 2009/0165668 | A1 | 7/2009 | Andreetto | |

FOREIGN PATENT DOCUMENTS

| | | |
|---|---|---|
| AT | 373832 | 2/1984 |
| AT | 388146 | 5/1989 |
| AT | 390926 | 7/1990 |
| AT | 389087 | 3/2008 |
| CH | 259291 | 1/1949 |
| CH | 360704 | 3/1962 |
| CH | 542740 | 10/1973 |
| CH | 554761 | 10/1974 |
| DE | 423865 | 1/1926 |
| DE | 2020746 | 12/1971 |
| DE | 2101743 | 9/1972 |
| DE | 2636888 | 5/1977 |
| DE | 3109294 | 10/1982 |
| DE | 3834116 | 5/1989 |
| DE | 3927757 | 3/1991 |
| DE | 4127373 | 2/1993 |
| DE | 202007006169 | 7/2007 |
| EP | 0055955 | 7/1982 |
| EP | 0135239 | 3/1985 |
| EP | 0158095 | 10/1985 |
| EP | 0218306 | 4/1987 |
| EP | 0218897 | 4/1987 |
| EP | 0281205 | 9/1988 |
| EP | 0491632 | 6/1992 |
| EP | 0517622 | 12/1992 |
| EP | 0613807 | 9/1994 |
| EP | 0640518 | 3/1995 |
| EP | 0678433 | 10/1995 |
| EP | 0687607 | 12/1995 |
| EP | 0692418 | 1/1996 |
| EP | 0745526 | 12/1996 |
| EP | 0970864 | 1/2000 |
| EP | 1077167 | 2/2001 |
| EP | 1088729 | 4/2001 |
| EP | 1174323 | 1/2002 |
| EP | 1195305 | 4/2002 |
| EP | 1209055 | 5/2002 |
| EP | 1331151 | 7/2003 |
| EP | 1364853 | 11/2003 |
| EP | 1419950 | 5/2004 |
| FR | 891743 | 3/1944 |
| FR | 913146 | 8/1946 |
| FR | 1100001 | 9/1955 |
| FR | 1199721 | 12/1959 |
| FR | 1423648 | 1/1966 |
| FR | 2340895 | 9/1977 |
| FR | 2387830 | 11/1978 |
| FR | 2391450 | 12/1978 |
| FR | 2392858 | 12/1978 |
| FR | 2562857 | 10/1985 |
| FR | 2640247 | 6/1990 |
| FR | 2670452 | 6/1992 |
| FR | 2706404 | 12/1994 |
| FR | 2823482 | 10/2002 |
| FR | 2867142 | 9/2005 |
| GB | 1326264 | 8/1973 |
| GB | 1353030 | 5/1974 |
| GB | 1460106 | 12/1976 |
| GB | 2017024 | 9/1979 |
| WO | WO2004067347 | 8/2004 |
| WO | WO2004085221 | 10/2004 |
| WO | WO2005032901 | 4/2005 |
| WO | WO2008020021 | 2/2008 |
| WO | WO2008129017 | 10/2008 |
| WO | WO2008129019 | 10/2008 |
| WO | WO2009/000059 | 12/2008 |
| WO | WO2009019259 | 2/2009 |
| WO | WO2009053485 | 4/2009 |

* cited by examiner

SKI-LIFT SEAT RETURN DEVICE

PRIORITY CLAIM

This application claims the benefit of and priority to Italian Patent Application No. MI2009A 001414, filed on Aug. 4, 2009, the entire contents of which are incorporated by reference herein.

BACKGROUND

Known ski-lifts employ transportation units comprising disk- or anchor-shaped seats for towing passengers up a slope; and return devices, each comprising a cable fixed at one end to a respective seat.

Such known ski-lift seat return devices normally comprise a supporting structure; a reel mounted to rotate about an axis with respect to the supporting structure; said cable, which is wound about the reel; a spring mechanism connected to the supporting structure and the reel to oppose unwinding of the cable, and to rewind the cable when it is unwound off the reel; and a brake to prevent acceleration and speeding of the reel and cable.

Return devices such as these are known from Austrian Patent No. 389 087 B, German Patent No. 26 36 888 A1, and European Patent No. 0 158 095 A1, in which the brake employs a viscous fluid to exert a brake torque to prevent the reel from speeding. While the above known devices have proved highly effective, such devices have the drawback of the viscous fluid requiring an airtight chamber and being temperature-sensitive, which means the brake torque is also affected by temperature.

Other known return devices feature a brake comprising parts in sliding contact. However, devices of this sort therefore need maintenance to replace the worn contacting parts.

SUMMARY

The present disclosure relates to a ski-lift seat return device.

More specifically, the present disclosure provides a return device for a ski-lift transportation unit seat, configured to eliminate the above described drawbacks of the known art, and which provides effective brake torque regardless of temperature, is easy to produce, and needs little maintenance.

According to one embodiment of the present disclosure, there is provided a return device for a ski-lift seat, the return device comprising a supporting structure; a reel mounted to rotate about a first axis with respect to the supporting structure; a cable wound about the reel; a spring mechanism for opposing unwinding of the cable, and for rewinding the cable unwound off the reel; and a contactless magnetic brake connected to the reel and the supporting structure to adjust the brake torque as a function of the rotation speed of the reel; and wherein the magnetic brake comprises a first wall integral with said supporting structure (and in one embodiment, defining part of said supporting structure); and a second wall connected movably to the reel and moved towards the first wall by the rotation speed of the reel; the first and second wall being coupled magnetically to each other.

The magnetic brake of the present disclosure thus eliminates the drawbacks of the known art by having no sliding parts or viscous fluid.

Moreover, the brake torque increases with the speed of the reel, by bringing the magnetically coupled first and second walls closer together, and is practically negligible at very low reel speeds. The job of the ski-lift operator, at the bottom station, of repeatedly extracting the cable and accommodating the passenger on the seat is therefore made easier and less tiring, and the brake torque is most effective at relatively high reel speeds, by bringing the magnetically coupled first and second walls closer together.

Additional features and advantages are described in, and will be apparent from, the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
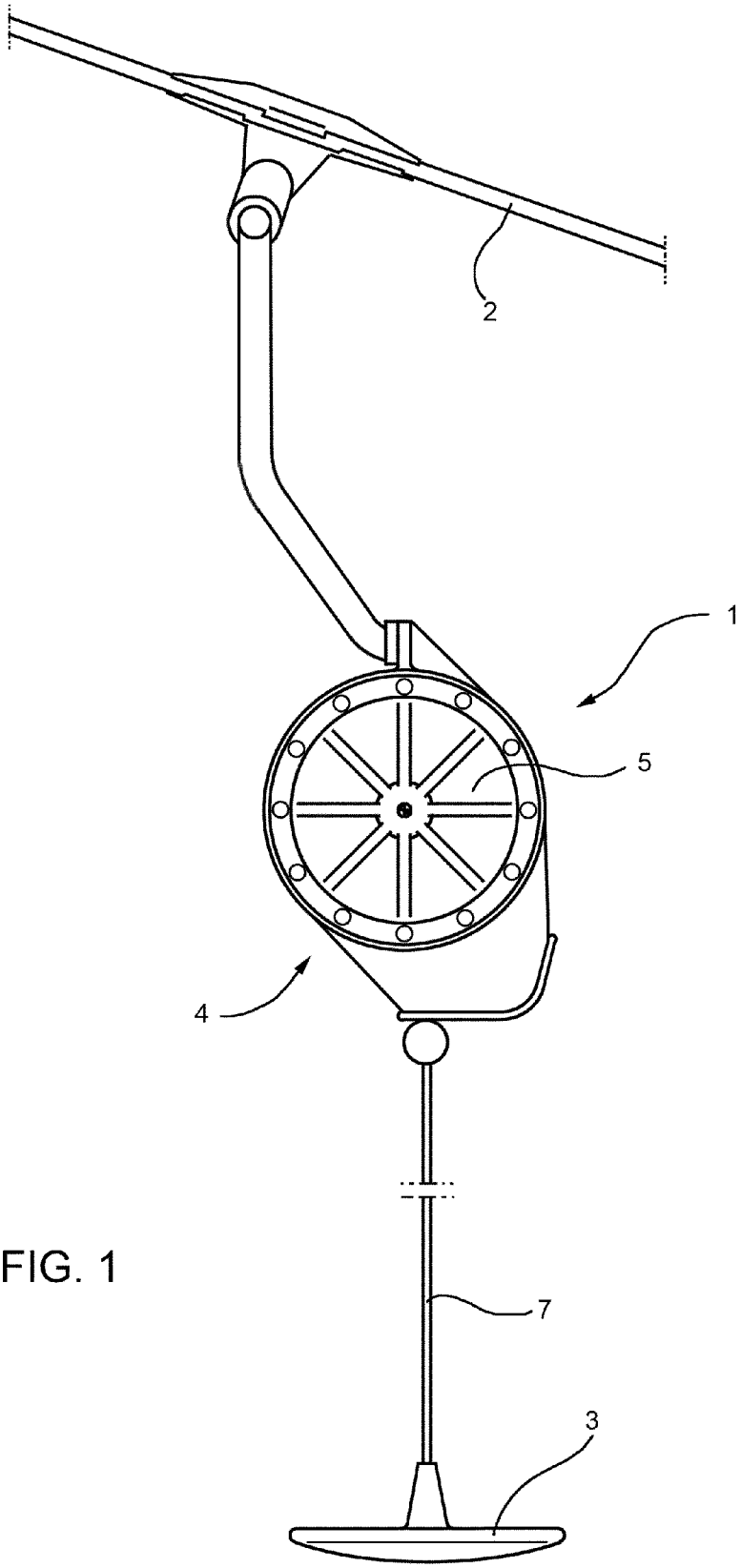
FIG. 1 shows a schematic side view, with parts removed for clarity, of a ski-lift transportation unit comprising a seat return device in accordance with the present disclosure.

Referring now to the example embodiments of the present disclosure illustrated in FIGS. 1 to 4, number 1 in FIG. 1 indicates as a whole a ski-lift transportation unit, which operates between a bottom station and a stop station (not shown), and comprises a load-bearing haul cable 2.

Transportation unit 1 comprises a seat 3 normally defined by a disk or anchor; and a return device 4, for seat 3, connected to cable 2.

Figure 2:
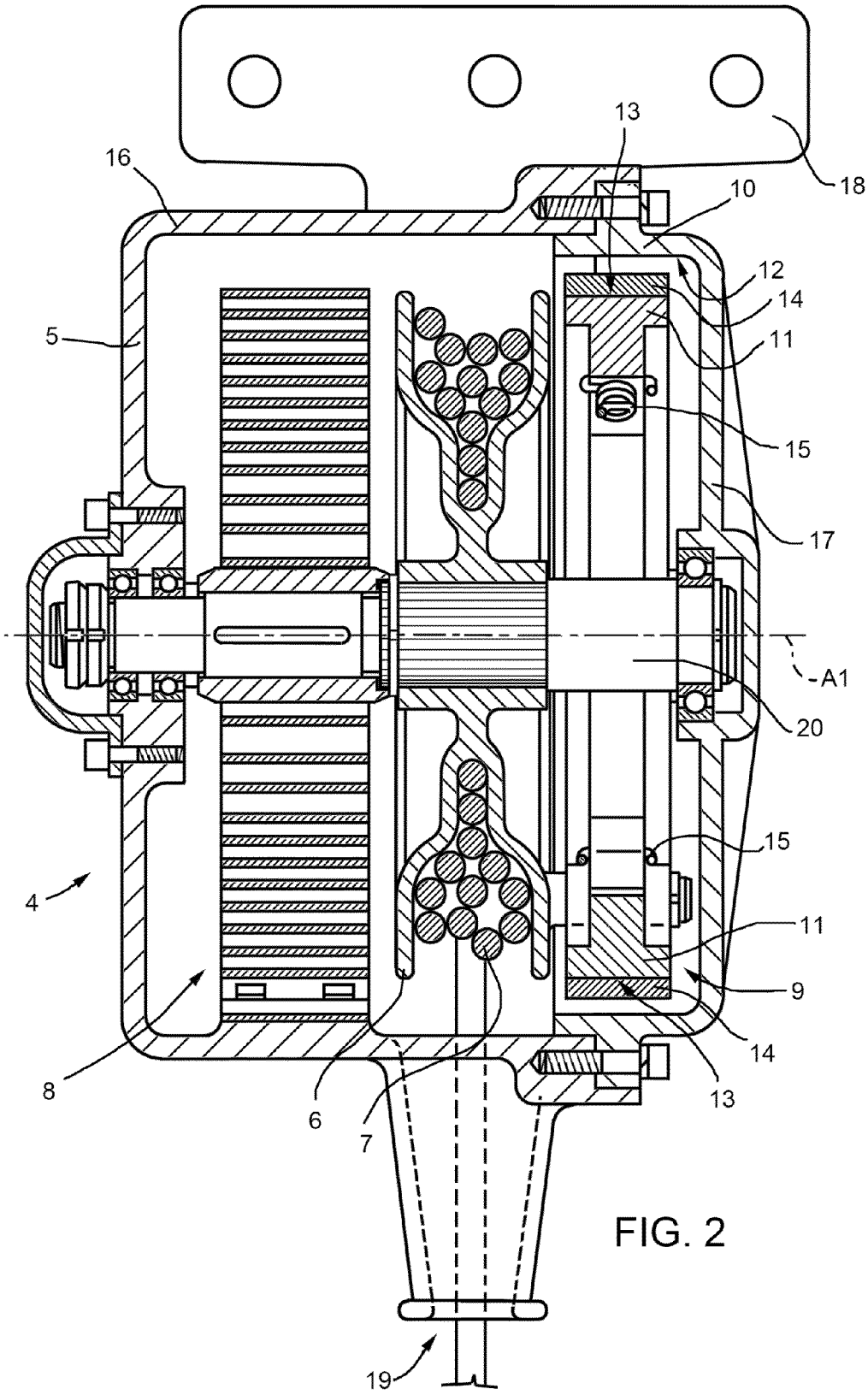
FIG. 2 shows a larger-scale, longitudinal section, with parts removed for clarity, of the FIG. 1 return device.

With reference to FIG. 2, return device 4 comprises a supporting structure 5—in the example shown, a supporting box; a reel 6 mounted to rotate about an axis A1 with respect to supporting structure 5; a cable 7 connected at one end to reel 6 and at the other end to seat 3 (FIG. 1), and wound about reel 6; a spring mechanism 8 for opposing unwinding of cable 7, and for rewinding cable 7 when unwound partly or completely off reel 6; and a magnetic brake 9 connected to reel 6 and supporting structure 5 to adjust the brake torque as a function of the rotation speed of reel 6 about axis A1.

Magnetic brake 9 substantially comprises a first wall 10 and a second wall 11, which exchange magnetic forces. First wall 10 is integral with and, in the example shown, defines parts of supporting structure 5; second wall 11 is connected to reel 6, and is moved towards first wall 10 by the centrifugal force produced by rotation of reel 6 about axis A1; the brake torque is inversely proportional to the distance between first and second wall 10 and 11; and first wall 10 has a substantially cylindrical first face 12 facing a substantially cylindrical second face 13 of second wall 11.

Magnetic brake 9 comprises a number of permanent magnets 14 in second wall 11. In the example shown, permanent magnets 14 are arranged along second face 13 to produce a magnetic field that interacts with first wall 10, which is made of electrically conducting material. The magnetic field produced by permanent magnets 14 induces electric current in first wall 10 when second wall 11 moves with respect to first wall 10. This induced current produces an induced magnetic field, which opposes the magnetic field produced by permanent magnets 14 and so produces a brake torque that is inversely proportional to the distance between first and second wall 10 and 11. The brake torque also depends on (i.e., is directly proportional to), the rotation speed of reel 6 about axis A1.

Preferably, first wall 10 is made of steel, and second wall 11 of aluminum or steel.

Magnetic brake 9 comprises a first stop for second wall 11, to prevent permanent magnets 14 from contacting first wall 10 (i.e., remain contactless); and a second stop to prevent second wall 11 and permanent magnets 14 from moving too far away from first wall 10.

Magnetic brake 9 comprises an elastic member 15 fitted to second wall 11 to oppose the centrifugal force-induced movement of second wall 11, and to position second wall 11 in a rest position resting against the second stop.

In another variation (not shown), permanent magnets 14 form part of first wall 10, and second wall 11 has no permanent magnets 14.

The first stop is adjustable by threaded pins G (FIGS. 3 and 4) which alter the contact configuration of the first stop.

In another variation (not shown), the second stop is also adjustable by threaded pins which alter the contact configuration of the second stop.

In the FIG. 2 example, supporting structure 5 comprises two half-shells 16 and 17 fitted together; and half-shell 17 comprises first wall 10 which, in the example shown, is cylindrical. Supporting structure 5 also comprises a fastening flange 18; an opening 19 for cable 7; and a shaft 20 fitted to half-shells 16 and 17 to rotate about axis A1.

Figure 3:
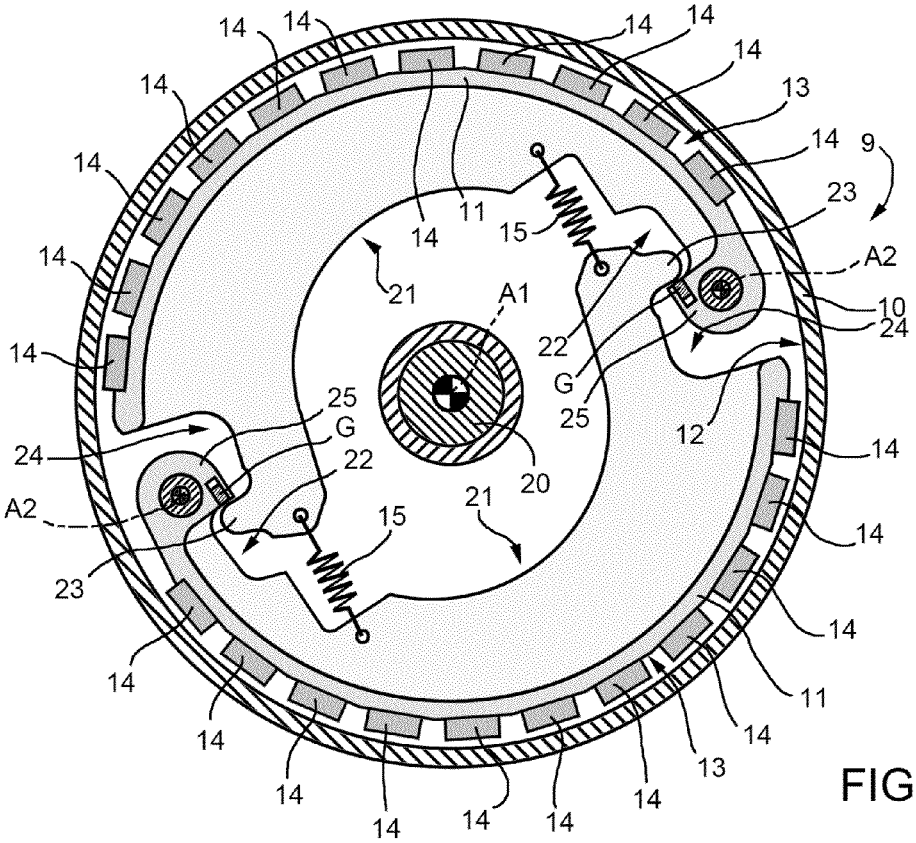
FIGS. 3 and 4 show larger-scale cross sections, with parts removed for clarity, of the FIG. 2 return device in respective operating positions.
Figure 4:
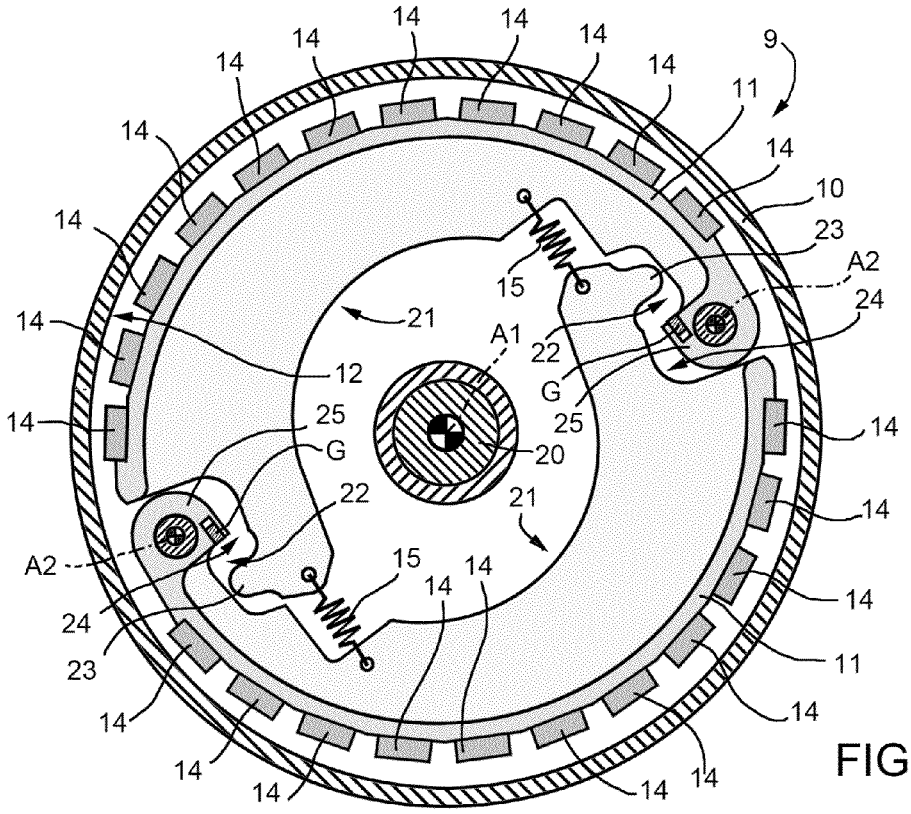

With reference to FIGS. 3 and 4, magnetic brake 9 comprises two arc-shaped shoes 21, each hinged to reel 6 about a respective axis A2 parallel to axis A1.

Second wall 11 extends along the two shoes 21, and the hinge connection of shoes 21 about axes A2 enables second wall 11 to move towards and away from first wall 10. Each shoe 21 has a first end hinged about a respective axis A2; and a second end connected to the other shoe 21 by an elastic member 15, close to the first end of the other shoe 21.

Each shoe 21 has a first recess 22 located close to the first end, and with its concavity facing axis A1; and a first projection 23 located at the second end and loosely engaging the first recess 22 of the other shoe 21, so that each shoe 21 limits the outward radial movement of the other shoe 21, as shown in FIG. 3, and so forms the first stop.

Each shoe 21 also has a second recess 24 located at the second end; and a second projection 25 located at the first end and loosely engaging the second recess 24 of the other shoe 21, so that each shoe 21 limits the inward radial movement of the other shoe 21, as shown in FIG. 4, and so forms the second stop.

The size of each recess 22 is adjustable by threaded pin G engaging relative projection 25, so as to adjust the first stop and therefore the minimum distance between first and second wall 10 and 11.

The present disclosure thus has the advantage of not employing temperature-sensitive viscous fluid, or sliding parts subject to wear.

Moreover, the present disclosure provides for a considerable variation in brake torque as a function of speed, on account of the brake torque of the magnetic brake—which in itself depends on reel rotation speed—also varying alongside a variation in the distance between the first and second wall. This makes the ski-lift operator's job of accommodating passengers on the seats much less tiring, while still ensuring the maximum brake torque necessary to prevent the reel from speeding.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A ski-lift seat return comprising:
- a supporting structure;
- a reel mounted to rotate about a first axis with respect to the supporting structure;
- a cable wound about the reel;
- a spring mechanism configured to: (i) oppose an unwinding of the cable and (ii) cause a rewinding the cable; and
- a contactless magnetic brake connected to the reel and the supporting structure, said contactless magnetic brake configured to adjust the brake torque as a function of the rotation speed of the reel, the magnetic brake including:
  - a first wall connected to said supporting structure,
  - a second wall movably connected to the reel, said second wall configured to move towards the first wall as the rotation speed of the reel increases, wherein the first wall and the second wall are magnetically coupled to each other, and
  - a first stop configured to limit movement of the second wall and to prevent contact between the first wall and the second wall.

2. The ski-lift seat return of claim 1, wherein the first stop includes an adjusting member configured to adjust the minimum distance between the first wall and the second wall.

3. The ski-lift seat return of claim 1, wherein the magnetic brake includes an elastic member fitted to the second wall and configured to counteract the movement of the second wall produced by the rotation speed of the reel about the first axis.

4. The ski-lift seat return of claim 3, wherein the magnetic brake includes a second stop configured to prevent the elastic member from positioning the second wall more than a designated distance from the first wall.

5. The ski-lift seat return of claim 4, wherein the second stop is adjustable.

6. The ski-lift seat return of claim 1, wherein the first wall and the second wall each have, respectively, a substantially cylindrical first face and second face facing each other, and at which magnetic forces are exchanged.

7. The ski-lift seat return of claim 6, wherein the second wall extends along two arc-shaped shoes, each shoe being hinged at a first end to the reel about a respective second axis parallel to the first axis, said shoe being configured to radially move towards the first wall by centrifugal force.

8. The ski-lift seat return of claim 7, wherein each shoe has a second end connected to the first end of the other shoe by an elastic member.

9. The ski-lift seat return of claim 7, wherein each shoe includes:
- a first recess adjacent to the first end; and
- a first projection located at the second end and configured to engage the first recess of the other shoe to limit radial movement of the other shoe towards the first wall.

10. The ski-lift seat return of claim 7, wherein each shoe includes:
- a second recess adjacent to the second end; and
- a second projection located at the first end and configured to engage the second recess of the other shoe to limit the radial movement of the other shoe towards the first axis.

11. The ski-lift seat return of claim 1, wherein the magnetic brake includes a plurality of permanent magnets arranged along the second wall and facing the first wall.

12. The ski-lift seat return device of claim 1, wherein the first wall defines part of said supporting structure.

13. A ski-lift seat return comprising:

a supporting structure;

a reel mounted to rotate about a first axis with respect to the supporting structure;

a cable wound about the reel; and a contactless magnetic brake connected to the reel and the supporting structure, said contactless magnetic brake configured to adjust the brake torque as a function of the rotation speed of the reel, the magnetic brake including:

a first wall connected to said supporting structure, a second wall magnetically coupled to the first wall and movably connected to the reel, said second wall configured to move towards the first wall as the rotation speed of the reel increases, and a first stop configured to limit movement of the second wall and to prevent contact between the first wall and the second wall.

14. The ski-lift seat return of claim 13, wherein the first stop includes an adjusting member configured to adjust the minimum distance between the first wall and the second wall.

15. The ski-lift seat return of claim 13, wherein the magnetic brake includes an elastic member fitted to the second wall and configured to counteract the movement of the second wall produced by the rotation speed of the reel about the first axis.

16. The ski-lift seat return of claim 15, wherein the magnetic brake includes a second stop configured to prevent the elastic member from positioning the second wall more than a designated distance from the first wall.

17. The ski-lift seat return of claim 13, wherein the magnetic brake includes a plurality of permanent magnets arranged along the second wall and facing the first wall.

18. The ski-lift seat return device of claim 13, wherein the first wall defines part of said supporting structure.

* * * * *